US012622510B2

(12) United States Patent
Chunrong et al.

(10) Patent No.: US 12,622,510 B2
(45) Date of Patent: May 12, 2026

(54) ELECTRIC HEIGHT-ADJUSTABLE DESK

(71) Applicants: Qidong Vision Mounts Manufacturing Co., Ltd., Nantong (CN); CKnapp Sales, Inc., Goodfield, IL (US)

(72) Inventors: Huang Chunrong, Nantong (CN); Zhao Zhenpu, Nantong (CN)

(73) Assignees: Qidong Vision Mounts Manufacturing Co., Ltd., Nantong (CN); CKnapp Sales, Inc., Goodfield, IL (US)

( * ) Notice: Subject to any disclaimer, the term of this patent is extended or adjusted under 35 U.S.C. 154(b) by 32 days.

(21) Appl. No.: 18/699,208

(22) PCT Filed: Oct. 11, 2023

(86) PCT No.: PCT/CN2023/012476
§ 371 (c)(1),
(2) Date: Apr. 5, 2024

(65) Prior Publication Data

US 2025/0213032 A1 Jul. 3, 2025

(30) Foreign Application Priority Data

Aug. 12, 2022 (CN) ..... 202210970179.8

(51) Int. Cl.
*A47B 9/04* (2006.01)
*A47B 9/20* (2006.01)

(52) U.S. Cl.
CPC ..... *A47B 9/04* (2013.01); *A47B 9/20* (2013.01); *A47B 2009/043* (2013.01); *A47B 2009/046* (2013.01)

(58) Field of Classification Search
CPC .... A47B 9/04; A47B 9/06; A47B 9/20; A47B 2009/043; A47B 2009/046
(Continued)

(56) References Cited

U.S. PATENT DOCUMENTS 2,249,455 A * 7/1941 Caldwell ..... A47B 23/04 108/147
2,759,779 A 8/1956 Bergman
(Continued)

FOREIGN PATENT DOCUMENTS

CN 107594882 A 1/2018
CN 210184885 U 3/2020
(Continued)

OTHER PUBLICATIONS

International Searching Authority, "International Search Report," issued in connection with International Patent Application No. PCT/CN2023/124076, mailed on Dec. 21, 2023, 7 pages.
(Continued)

*Primary Examiner* — Jose V Chen
(74) *Attorney, Agent, or Firm* — Hanley, Flight & Zimmerman, LLC

(57) ABSTRACT

Example height adjustable desks are disclosed herein. An example height adjustable desk includes telescoping legs, each telescoping leg including an upper section, a lower section, and an actuator, each telescoping leg having a first end and a second end; a drive system having a motor and a worm gear assembly having a worm and a worm wheel; gearboxes, each gearbox coupled to a respective telescoping leg; transmission shafts connected to the drive system and to the gearboxes wherein the drive system is configured to drive the transmission shafts to drive the telescoping legs together to raise and lower; and a desktop having work surfaces including a first work surface, a second work surface, and a third work surface, the first ends of the telescoping legs to interface with and support the desktop, wherein the desktop is formed by coupling two or more of the work surfaces.

20 Claims, 7 Drawing Sheets

(58) Field of Classification Search
USPC ..... 108/144.11, 147
See application file for complete search history.

(56) References Cited

U.S. PATENT DOCUMENTS 3,255,721 A 6/1966 Peterschmidt
3,521,579 A 7/1970 Stafford
3,533,362 A 10/1970 Thompson
3,927,924 A 12/1975 Kelley
4,049,331 A 9/1977 Gutmann
4,850,563 A 7/1989 Grout
5,024,167 A 6/1991 Hayward
5,253,595 A 10/1993 Heidmann
5,373,793 A * 12/1994 Crossman ..... A47B 9/04 108/42
5,483,900 A 1/1996 Elzenbeck
5,549,053 A * 8/1996 Grout ..... A47B 9/06 108/147
5,568,775 A 10/1996 Rizzi et al.
5,606,920 A 3/1997 Meyer et al.
5,676,068 A 10/1997 Kallander
5,685,510 A * 11/1997 Frankish ..... A47B 17/02 248/188.4
5,715,760 A 2/1998 Frascaroli et al.
5,943,966 A 8/1999 Machado et al.
5,974,985 A 11/1999 Flototto et al.
5,984,566 A 11/1999 Blaha
6,000,343 A 12/1999 Laney
6,145,448 A 11/2000 Marschand et al.
6,148,741 A * 11/2000 Motta ..... A47B 9/04 108/147
6,182,580 B1 2/2001 Barrett et al.
6,382,109 B1 * 5/2002 Novikoff ..... A47B 87/002 108/65
6,935,250 B1 * 8/2005 Arnold ..... A47B 9/04 248/188.4
7,487,690 B2 * 2/2009 Liu ..... A47B 9/04 74/89.45
7,765,937 B2 8/2010 Weissenrieder et al.
8,104,410 B2 * 1/2012 Lanfear ..... A47B 9/20 108/157.1
8,256,359 B1 9/2012 Agee
8,967,054 B2 3/2015 Henriott et al.
9,420,879 B1 8/2016 Brandenberg
9,516,946 B1 12/2016 Edwards
9,808,082 B1 11/2017 Nelson
9,848,696 B2 12/2017 Tseng
10,271,642 B1 4/2019 Lin
10,327,542 B2 6/2019 Oberndorfer
10,349,737 B2 7/2019 Keller et al.
10,531,732 B1 * 1/2020 Huang ..... F16B 7/14
10,709,234 B1 7/2020 Brennan
10,791,826 B2 10/2020 Crowe et al.
10,842,258 B2 11/2020 Applegate et al.
11,026,506 B1 6/2021 Murray et al.
11,089,864 B2 8/2021 Davidsen
11,096,481 B2 8/2021 Patton
D933,400 S * 10/2021 Wang ..... D6/648
11,166,546 B2 * 11/2021 Lin ..... A47B 9/04
11,357,320 B2 6/2022 Jørgensen
11,877,649 B1 1/2024 Addington et al.
11,969,087 B1 4/2024 Kayali
12,245,696 B2 * 3/2025 Li ..... A47B 9/04
2002/0026755 A1 3/2002 Jones
2003/0070595 A1 4/2003 Crinion
2004/0097135 A1 5/2004 Brooks
2005/0045073 A1 3/2005 Wasley
2005/0166805 A1 8/2005 Loines
2006/0117669 A1 6/2006 Baloga et al.
2007/0068429 A1 3/2007 Frazier
2008/0178779 A1 * 7/2008 Agee ..... A47B 9/20 108/147
2010/0050911 A1 3/2010 Rouillard
2010/0126393 A1 * 5/2010 Moller ..... A47B 9/20 108/147
2010/0126394 A1 5/2010 Burak et al.
2010/0186638 A1 7/2010 Roy et al.
2011/0023758 A1 * 2/2011 Overgaard ..... A47B 9/06 108/147
2011/0168062 A1 7/2011 DellaVecchia
2011/0277671 A1 11/2011 Pryor
2011/0297052 A1 12/2011 Martin et al.
2012/0073480 A1 3/2012 Korb
2012/0287226 A1 11/2012 Baloga et al.
2012/0304900 A1 12/2012 Henriott et al.
2013/0312642 A1 11/2013 Martin et al.
2014/0083337 A1 3/2014 Isgro
2014/0106610 A1 4/2014 Byrne et al.
2014/0182229 A1 7/2014 Dame et al.
2014/0318423 A1 10/2014 Parshad
2014/0360413 A1 12/2014 Schenk et al.
2015/0150370 A1 6/2015 Korb et al.
2015/0230602 A1 8/2015 Glockl
2015/0272318 A1 10/2015 Isgro
2016/0073779 A1 3/2016 Ringlein
2016/0095428 A1 4/2016 Turner
2016/0113388 A1 4/2016 Distefano
2016/0255950 A1 9/2016 Mata Valdes et al.
2016/0270528 A1 9/2016 Scharing et al.
2016/0338491 A1 11/2016 Demichael et al.
2016/0345722 A1 * 12/2016 Chen ..... A47B 9/04
2016/0345723 A1 12/2016 Lanphear
2017/0080897 A1 3/2017 Nordbruch
2017/0135465 A1 5/2017 Tao
2017/0164731 A1 6/2017 Kemnitzer et al.
2017/0188698 A1 7/2017 Chen et al.
2017/0258225 A1 9/2017 Reeves et al.
2017/0303679 A1 * 10/2017 Tseng ..... A47B 9/04
2017/0325583 A1 11/2017 Abraham et al.
2018/0360207 A1 12/2018 Neudeck et al.
2018/0368569 A1 * 12/2018 Laing ..... A47B 17/02
2019/0045920 A1 2/2019 Patton et al.
2019/0045923 A1 2/2019 Lee
2019/0191868 A1 6/2019 Bowser
2019/0223590 A1 7/2019 Moore
2019/0231069 A1 8/2019 Mehandjiysky et al.
2019/0246791 A1 8/2019 Lundberg et al.
2019/0261772 A1 8/2019 Lin
2019/0357668 A1 * 11/2019 Knudtson ..... A47B 9/04
2020/0069052 A1 3/2020 Allen et al.
2020/0128951 A1 4/2020 Anderson et al.
2020/0154876 A1 5/2020 Liu
2020/0221863 A1 * 7/2020 Laing ..... A47B 9/00
2020/0281349 A1 9/2020 Grabowski et al.
2020/0390240 A1 12/2020 Hove et al.
2021/0100355 A1 * 4/2021 Jørgensen ..... A47B 21/02
2021/0100356 A1 * 4/2021 Huang ..... A47B 17/03
2021/0215181 A1 7/2021 Maager
2021/0378400 A1 12/2021 Egger
2022/0087418 A1 3/2022 Baloga et al.
2022/0251832 A1 8/2022 Kroon et al.
2022/0257002 A1 8/2022 Williams et al.
2022/0322821 A1 10/2022 Parekh
2022/0338617 A1 * 10/2022 Höglund ..... A47B 9/20
2023/0000244 A1 * 1/2023 Lin ..... A47B 9/04
2023/0029425 A1 * 1/2023 Lin ..... A47B 9/20
2023/0062121 A1 3/2023 Miller et al.
2023/0389692 A1 12/2023 Stoelinga
2024/0008635 A1 * 1/2024 Rong ..... A47B 9/04
2024/0049877 A1 2/2024 Weideman et al.
2025/0143449 A1 * 5/2025 Douglas ..... A47B 13/088

FOREIGN PATENT DOCUMENTS

CN 115153181 A 10/2022
CN 217743513 U 11/2022
CN 219613300 U 9/2023
DE 19600364 A1 8/1996
DE 19962277 A1 6/2001
EP 3440958 A1 2/2019
EP 3172989 B1 3/2021
EP 3282892 B1 3/2022

(56) References Cited

FOREIGN PATENT DOCUMENTS

| | | | |
|---|---|---|---|
| KR | 20150101797 | A | 9/2015 |
| SE | 1951289 | A1 | 5/2021 |
| WO | 2016166109 | A1 | 10/2016 |

OTHER PUBLICATIONS

International Searching Authority, "Written Opinion," issued in connection with International Patent Application No. PCT/CN2023/124076, mailed on Dec. 21, 2023, 4 pages.

* cited by examiner

ELECTRIC HEIGHT-ADJUSTABLE DESK

RELATED APPLICATIONS

This patent arises from the national stage of Chinese Application No. PCT/CN2023/012476, which was filed on Oct. 11, 2023, which claims priority to Chinese Application No. 202210970179.8, which was filed on Aug. 12, 2022. Chinese Application No. PCT/CN2023/012476 and Chinese Application No. 202210970179.8 are hereby incorporated herein by reference in their entirety. Priority to Chinese Application No. PCT/CN2023/012476 and Chinese Application No. 202210970179.8 are hereby claimed.

FIELD OF THE DISCLOSURE

This disclosure relates generally to desks and, more particularly, to a height adjustable desks.

BACKGROUND

In recent years, people have grown increasingly concerned with risks stemming from prolonged periods of sitting. Prolonged sitting has been associated with a number of health concerns, such as increased risk of heart disease, stroke, diabetes, and premature death, and overall deconditioning of the human body, including early muscle fatigue, back pain, and spinal issues. Standing desks and height adjustable desks have become popular alternatives to traditional sitting desks because they allow user to stand while utilizing the desk's surface. A standing desk is a desk that is of sufficient height to enable a user to utilize the desk while in a standing (e.g., upright) position, whereas a height adjustable desk is a desk that allows the user to transition between a sitting position and a standing position by adjusting a height of the adjustable desk.

BRIEF DESCRIPTION OF THE DRAWINGS

In general, the same reference numbers will be used throughout the drawing(s) and accompanying written description to refer to the same or like parts. The figures are not necessarily to scale.

DETAILED DESCRIPTION

Figure 1:
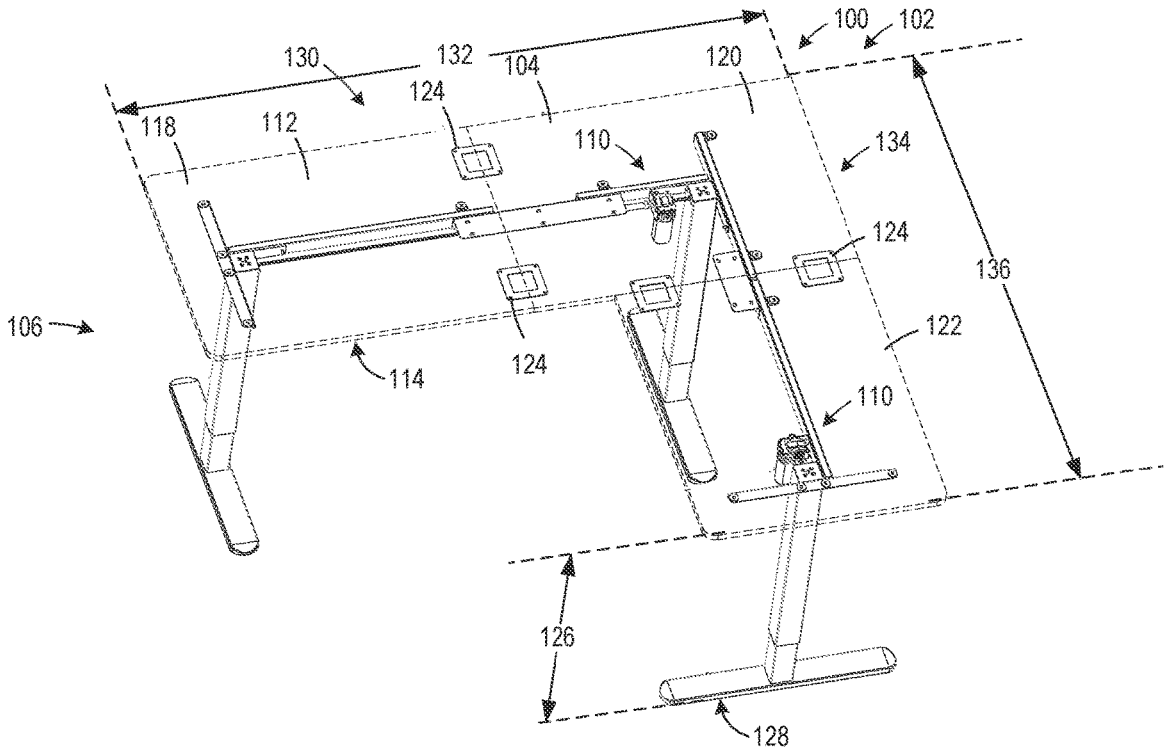
FIG. 1 is a schematic illustration of an example frame of an example height adjustable desk constructed in accordance with teachings of this disclosure.

In recent years, standing desks have gained popularity due to the ergonomic and/or health benefits such desks provide to a user. While standing desks are a healthier alternative to traditional sitting desks, continuous standing is often an undesirable alternative to continuous sitting. As such, adjustable (e.g., convertible, sit-to-stand, lift, height adjustable) desks/tables continue to gain popularity amongst desk users. A height adjustable desk is a type of table that can lift and lower a table body. Height adjustable desks are different from ordinary desks. A height adjustable desk typically includes a plurality of adjustable legs (e.g., bars, columns, arms, etc.) that support a desktop (e.g., tabletop, table board, etc.) and a height adjustment mechanism to enable height adjustment of the desktop.

Height adjustable desks provide a great benefit to users who desire to alternate between sitting and standing within any given day. Height adjustable desks allow the user to adjust the height of a desktop, enabling a user to work alternately between sitting and standing positions to reduce potential harm to the human body caused by prolonged sitting. In some examples, the height adjustable desk enables improved work efficiency. As more people have schoolwork, careers, and/or other activities that require continuous use of a computer, demand for height adjustable desks will continue to increase.

With the popularity of online shopping, more people are customizing tableware and chairs online. Due to the different sizes and shapes of desktop customization, higher requirements are put forward for the adaptability of parts. Most height adjustable desks sold on the market today have a specific shape (e.g., configuration), and internal components are designed to be assembled into that shape. For example, currently, there are mainly two types of height adjustable desks: those with a linear desktop and those with an L-shaped desktop. However, users may desire to change the shape of height adjustable desks. For example, a user may desire to change a shape of a height adjustable desk due to changes in usage scenarios, such as assembling a straight desktop into an L-shaped desktop, or assembling an L-shaped desktop into a straight desktop, etc. To do so, higher requirements have been put forward for other parts. For example, the frame size supporting the desk body needs to adapt to the size of the desk, and the transmission mechanism needs to be adjusted for adaptability to meet the requirements of different desktop sizes and shape changes. Therefore, there is an urgent need to develop a height adjustable desk that can meet the customized needs of customers with different sizes and shapes of the desktop, while also meeting the transformation between different shapes in the later stage.

Examples disclosed herein enable manufacture of a height adjustable desk that includes a drive system (e.g., assembly) configured to synchronously adjust a length of two or more example telescoping legs (e.g., lift columns). Example height adjustable desks disclosed herein include an example desktop coupled to the telescoping legs via example connection components. Example telescoping legs disclosed herein include or otherwise implement actuators to enable lengthening and shortening of the telescoping legs to cause height adjustment of the example desktop. As such, the height of the adjustable desk can be varied.

Example height adjustable desks are configurable, enabling different arrangements of the height adjustable desk. Such structural arrangement is not only convenient for installation and transportation, but also convenient for customers to install and use in different environments.

Example desktops disclosed herein are spliced desktops that include multiple sections or work surfaces. In particular, the desktops disclosed herein include multiple work surfaces (e.g., desktop or table sections) that are coupled together to form a linked, cohesive work surface. In other words, a desktop or spliced desktop as disclosed herein refers to a desktop formed of multiple work surfaces combined to generate a cohesive surface. The work surfaces can be coupled in different configurations using the example connection components.

Example height adjustable desks disclosed herein include a height adjustment system that includes a drive system having a motor coupled to a worm gear assembly. Certain example height adjustment systems include gearboxes coupled to the actuators and/or the drive system and transmission shafts structured to couple the gearboxes to the drive system. Example height adjustable desks disclosed herein provide for synchronous height adjustment of two or more telescoping legs through the cooperation of the drive system, the gearboxes, and the transmission shafts.

Example height adjustable desks disclosed herein enable a reduced noise level of the height adjustable desk. For example, certain examples utilize a silent motor to further reduce a noise level. Certain examples provide for rotation transmission using an example worm gear assembly to enable reduced noise of height adjustable desk.

In some examples used herein, the term "substantially" is used to describe a relationship between two parts that is within five degrees of the stated relationship (e.g., a substantially same relationship is within five degrees of being the same, a substantially parallel relationship is within five degrees of being parallel, a substantially perpendicular relationship is within five degrees of being parallel etc.). In some examples used herein, the term "substantially" is used to describe a value that is within 10% of the stated value.

FIG. 1 illustrates an example height adjustable desk 100 in an example first configuration 102 in accordance with teachings of this disclosure. The height adjustable desk 100 includes an example desktop 104 (e.g., a work surface, a workstation, etc.), which is removably coupled to an example frame assembly 106 and an example drive system 110. The desktop 104 includes an example first (e.g., top) surface 112 and an example second (e.g., bottom) surface 114 opposite the first surface 112. The first surface 112 provides a work surface on which a user can place objects. For example, the user may position a computer, printer, keyboard, mouse, papers, and/or any other objects on the top surface 112. The second surface 114 interfaces with the frame assembly 106.

The height adjustable desk 100 of FIG. 1 is re-configurable. In particular, the desktop 104 is a spliced structure, including three example work surfaces 118, 120, 122 (e.g., table sections, desktop sections, etc.). However, the height adjustable desk 100 can include more than three work surfaces or less than three work surfaces in other examples. In this example, a first work surface 118 is associated with a substantially same size (e.g., length, width, height/thickness) as a second work surface 120. As used herein, a first component (e.g., a first work surface) is substantially the same size as a second component (e.g., a second work surface) means that a dimension (e.g., length, width, height/thickness) is within a tolerance range of +/−10% unless otherwise specified. A third work surface 122 is relatively smaller than the first and second work surfaces 118, 120 in terms of length and width. However, the work surface 118, 120, 122 can have any suitable size. That is, the work surface 118, 120, 122 can be of the same size, or one or more can be designed with different lengths and widths.

As illustrated in FIG. 1, the first configuration 102 of the height adjustable desk 100 is an L-shaped configuration. To facilitate the first configuration 102 of FIG. 1, the L-shaped desktop 104 includes the three work surfaces 118, 120, 122 (e.g., plates) that are spliced together. In other examples, the L-shaped desktop 104 can include more than three work surface or less than three work surfaces. Due to the use of L-shaped desktop 104, the configuration 102 of FIG. 1 is particularly suitable for placing in wall corners for users to use, maximizing the utilization of indoor space. The splicing capabilities of the desktop 104 and the structure of the frame assembly 106 enables different configurations that allow a user to choose how to build the height adjustable desk 100.

As illustrated in FIG. 1, the height adjustable desk 100 includes example connection brackets 124 to connect adjacent work surfaces 118, 120, 122. The connection brackets 124 can be positioned on either surface 112, 114 of the work surfaces 118, 120, 122 (e.g., at the top surface 112 and/or the bottom surface 114). The connection brackets 124 may include a connection board having holes through which fasteners can be positioned. The fasteners can include, but are not limited to, screws, rivets, etc. However, the connection brackets 124 can have other configurations in other examples. For example, the connection brackets can be shaped such that they can slidably connect to one another. With such structural arrangement, not only the installation is made easier, but also the stability and reliability of the desktop 104 is improved. In some examples, the connection brackets 124 can be omitted.

The height adjustable desk 100 is associated with an example height 126, which can be changed or adjusted. The height 126 extends from a first (e.g., lower) surface(s) 128 of the desk 100 to the first surface 112 of the desk 100. As discussed in further detail below, the frame assembly 106 includes components that enable adjustment of the height 126 of the desk 100.

As shown in FIG. 1, the first configuration 102 of the height adjustable desk 100 results in an L-shaped desk. In the first configuration 102, the desktop 104 includes a first side 130 (e.g., a first length, etc.) having a first length 132, which is relatively longer than a second side 134 (e.g., a second length, etc.) having a second length 136. In particular, in the first configuration, the first length 132 is larger than the second length 136.

Figure 2:
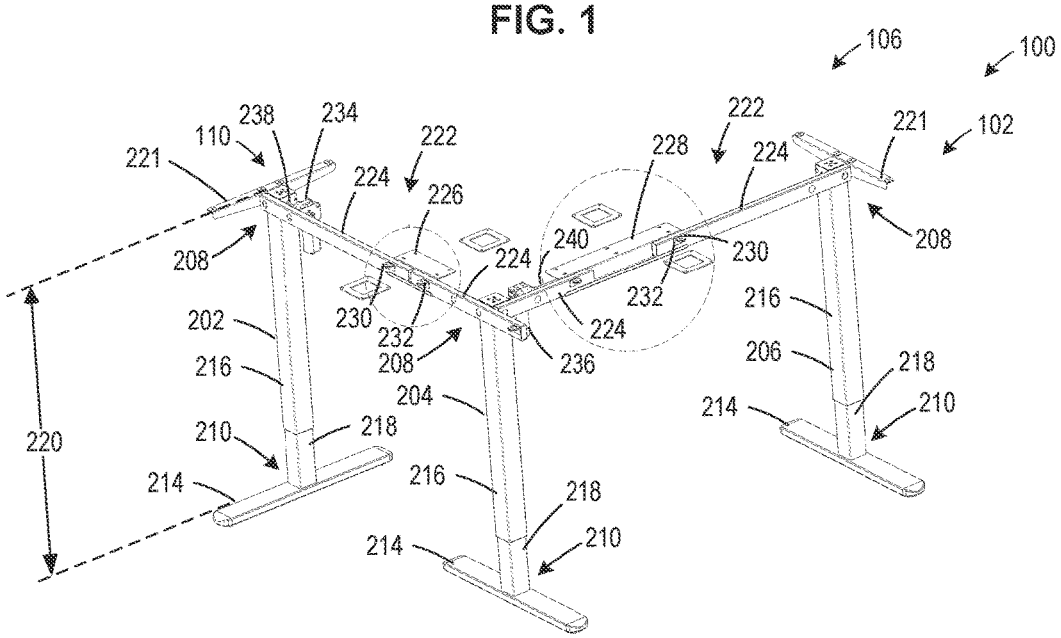
FIG. 2 is another schematic illustration of the example frame of the example height adjustable desk of FIG. 1.

FIG. 2 illustrates the frame assembly 106 of FIG. 1 in the first configuration 102. The frame assembly 106 provides structural support for the height adjustable desk 100. The frame assembly 106 of FIG. 1 includes three example telescoping legs 202, 204, 206 (e.g., retractable legs, lift columns etc.) that carry and support the desktop 104 (FIG. 1). In this example, each telescoping leg 202, 204, 206 is located separately below a respective work surface 118, 120, 122 (FIG. 1). Each telescoping leg 202, 204, 206 includes a first end 208 that interfaces with the second surface 114 of the desktop 104, and a second end 210 that interfaces with a support 214 and/or a floor area. Each telescoping leg 202, 204, 206 is associated with a length 220 measured from the first end 208 of the telescoping leg(s) 202, 204, 206 to a respective second end 212 of the respective telescoping leg(s) 202, 204, 206.

The support 214 can include, for example, a foot, a foot pad, a castor wheel, etc. The supports 214 facilitate the stability of the height adjustable desk 100. In some examples, the support 214 may be coupled to or otherwise include an additional base support(s). For example, a base support(s) in the form of a foot may include a pad(s) to prevent or otherwise limit damage to a floor beneath the desk 100 or a castor(s) to enable easy transport of the height adjustable desk 100 from a first location to a second location. In some examples, a support 214 is integrally formed with a respective telescoping leg(s) 202, 204, 206.

Each of the telescoping leg(s) 202, 204, 206 includes two or more example telescoping leg sections, such as an example upper (e.g., outer) section 216 and an example lower (inner) section 218. Such a configuration enables the upper section(s) 216 of the telescoping leg(s) 202, 204, 206 to slide relative to the lower section(s) 218, allowing the telescoping leg(s) 202, 204, 206 to change the length 220 of the telescoping leg(s) 202, 204, 206. While the telescoping legs 202, 204, 206 of FIG. 2 include two sections 216, 218, the telescoping legs can include more sections in other examples. As discussed in further detail below, a lead screw assembly (e.g., lead screw assembly 600 of FIG. 6) couples the upper section 216 and the lower section 218.

As the length 220 of the telescoping legs 202, 204, 206 changes (e.g., due to rotational action of the lead screw assembly 600), a corresponding height 126 of the height adjustable desk 100 changes. In particular, the height 126 of the heigh adjustable desk 100 at any given moment corresponds to the length 220 of the telescoping legs 202, 204, 206 at the given moment plus a thickness of the desktop 104 and/or a size of the supports 214.

As illustrated in FIG. 2, the frame assembly 106 also includes example brackets 221 and example connection frames 222 (e.g., cross beams, cross bars, connection rods, etc.) to couple the telescoping legs 202, 204, 206. However, the frame assembly 106 can include more or less components and/or different components in other examples. The brackets 221 enable connection of the desktop 104 to the frame assembly 106 (e.g., via fasteners, such as, but not limited to, screws, rivets, etc.). Each connection frame 222 of the illustrated example of FIG. 2 includes two example frame rods 224 and a respective example frame rod connector 226, 228 (e.g., bar connectors, brackets) to couple the frame rods 224. In particular, each frame rod 224 is coupled between a respective telescoping leg 202, 204, 206 and a respective frame rod connector 226, 228. In this example, the frame rods 224 are rectangular tubes. However, the frame rods 224 can have different shapes or profiles in other examples. In this example, the frame rod connectors 226, 228 are coupled to the bottom surface 116 of desktop 104. The frame assembly 106 can have other configurations in which the frame rod connectors 226, 228 are not directly connected to the desktop 104.

The frame connectors 224 of FIG. 2 include example tabs 230, which are positioned within example openings 232 in the frame rods 224. As discussed in relation to FIGS. 3 and 4, the connection frames 222 disclosed herein are different from existing technology, allowing the connection frame 222 to be suitable for splicing work surfaces 118, 120, 122 (FIG. 1) of different lengths. In some examples, fasteners are positioned through the tabs 230 to couple the frame assembly 106 to the desktop 104 and/or to secure or strengthen the connection frames 22.

As illustrated in FIG. 2, the drive system 110 of the height adjustable desk 100 includes illustrates an example first motor 234 and an example second motor 236. The motors 234, 236 provide rotation motion to the telescoping legs 202, 204, 206 through example transmission shafts 238. The first motor 234 of this example provides rotational power for one of the telescoping legs 202, 204, 206 (e.g., telescoping leg 202). The second motor 236 provides rotational power for the other telescoping legs 202, 204, 206 (e.g., telescoping legs 204, 206). In particular, the second motor 236 provides rotational motion to the third telescoping leg 206 via a transmission shaft 238 and an example sync rod 240.

Figure 3:
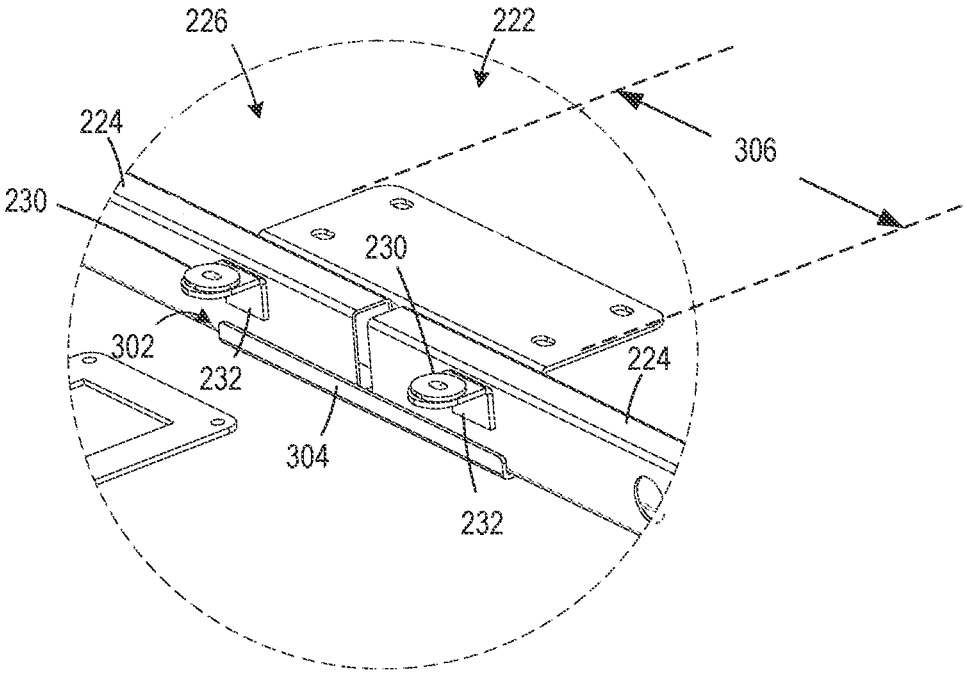
FIG. 3 is an enlarged view of a portion of the example frame of the example height adjustable desk of FIGS. 1-2.
Figure 4:
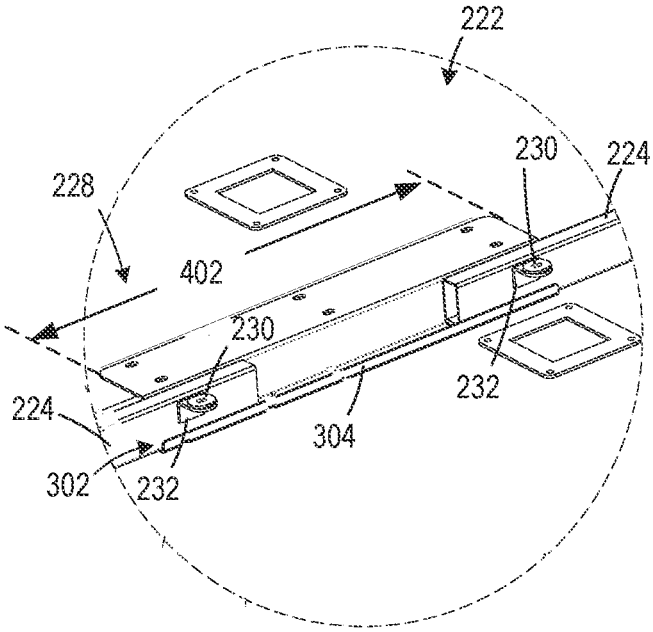
FIG. 4 is an enlarged view of another portion of the example frame of the example height adjustable desk of FIGS. 1-2.

FIGS. 3 and 4 illustrate the example frame rod connectors 226, 228 of FIG. 2, respectively. In particular, FIG. 3 illustrates a first frame rod connector 226 and FIG. 4 illustrates a second frame rod connector 228. As illustrated in FIGS. 3 and 4, the frame rod connectors 226, 228 include a groove 302 for the insertion of the frame rods 224. In particular, the groove 302 is defined by a portion 304 of the frame rod connector 226 that has a profile that corresponds to a profile of the frame rods 224. Further, the tabs 230 of frame rod connectors 226, 228 are positioned through the openings 232 of the frame rods 224. As such, the frame rods 224 are coupled to one another via the frame rod connectors 226, 228 to form the connection frames 222.

As shown in FIGS. 3 and 4, the first frame rod connector 226 of FIG. 3 is associated with a first length 306, which is shorter than a second length 402 associated with the second frame rod connector 228. The first rod frame connector 226 thus enables a relatively shorter connection frame 222, which can be suitable for shorter tables. On the other hand, the second frame rod connector 228 enables a relative longer connection frame 222, which can be suitable for supporting longer tables. Thus, the above structure is particularly suitable for customized desktops by customers.

The frame rods 224 are positioned below the work surfaces 118, 120, 122 (FIG. 1). Further, the frame rod connectors 226, 228 are located below a respective junction of two work surfaces 118, 120, 122. The frame rod connectors 226, 228 are coupled to the second surface 114 of the desktop 104 by fasteners, such as (but not limited to) rivets, screws, etc. In some examples, the frame rod connectors 226, 228 are formed by bending of a flat plate. The frame rod connectors 226, 228 ensure that the frame rods 224 can only slide laterally. Further, the frame rod connectors 226, 228 can transmit force between frame rods 224, thus carrying L-shaped height adjustable desk 100.

Figure 5:
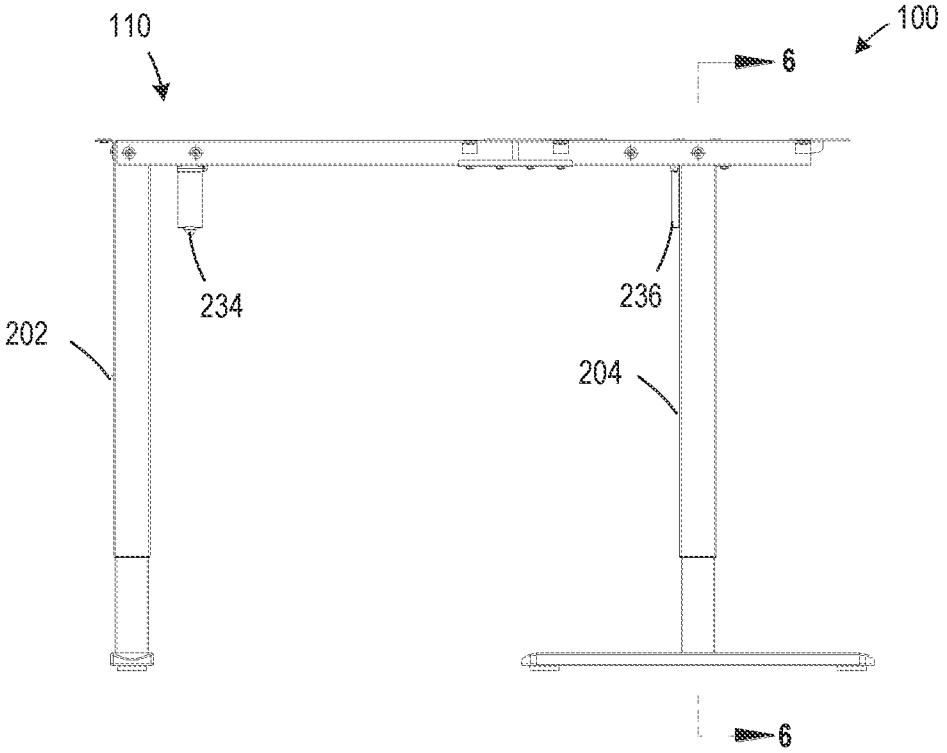
FIG. 5 illustrates another view of the height adjustable desk of FIGS. 1-4.

FIG. 5 illustrates another view of the example height adjustable desk 100 including a portion of an example drive system 110 in accordance with teachings of this disclosure. In particular, FIG. 5 illustrates the first motor 234 and a portion of the second motor 236. The first motor 234 provides rotational power for one of the telescoping legs 202, 204, 206. In the illustrated example of FIG. 5, the first motor 234 provides rotational power for the first one of the telescoping legs 202. The second motor 504 provides rotational power for the other telescoping legs 202, 204, 206, including the second and third telescoping legs 204, 206 (FIG. 2). However, the desk 100 can have other configurations in other examples.

Figure 6:
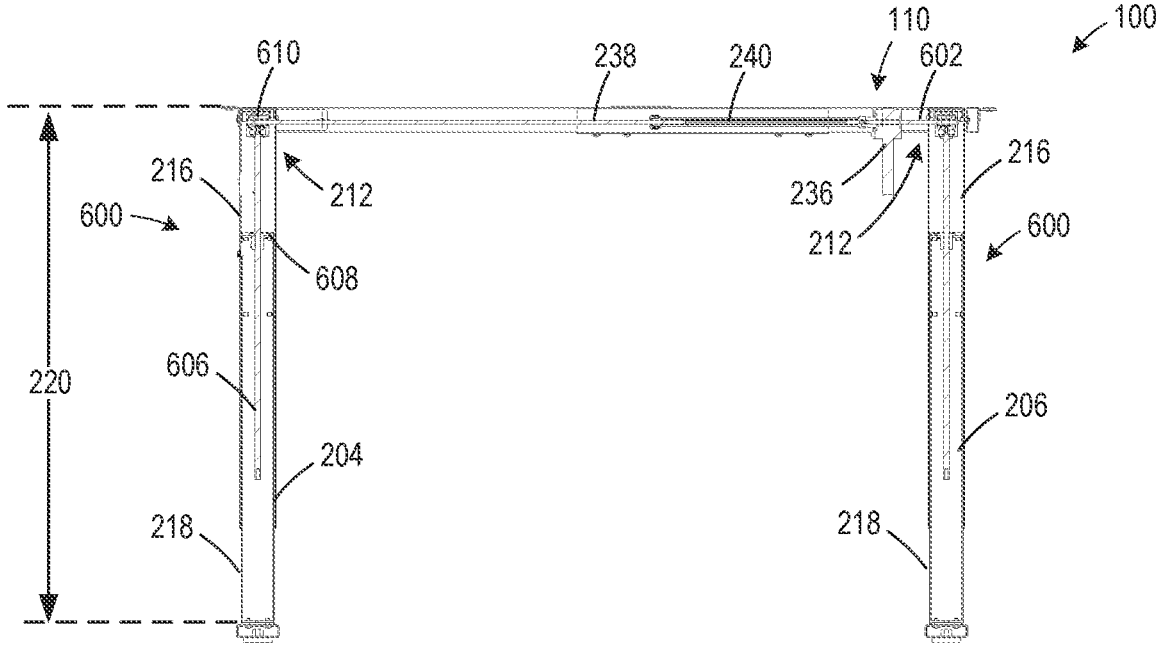
FIG. 6 illustrates a cross-section view of the height adjustable desk of FIGS. 1-5.

FIG. 6 is a cross sectional view of the height adjustable desk 100 of FIGS. 1-5. As illustrated in FIG. 6, the height adjustable desk 100 includes example lead screw assemblies 600 and the drive system 110. The telescoping legs 202, 204, 206 are movably coupled to the drive system 110 through the gearboxes 610, the transmission shafts 238, and/or the sync rod 240. The drive system 110 is structured to provide the rotational motion to the lead screw assemblies 600 through the motors 234, 236 (FIG. 5), the transmission shafts 238, and the sync rod 240. The transmission shafts 238 and/or the sync rod 240 transmit power/motion between the motors 234, 236 and the gearboxes 610. This enables the motors 234, 236 to provide rotation motion to the telescoping legs 202, 204, 206.

In some examples, each telescoping leg 202, 204, 206 includes a respective lead screw assembly 600. The lead screw assemblies 600 enable the telescoping legs 202, 204, 206 to be adjustable columns. While only the second and third telescoping legs 204, 206 are shown in FIG. 6, the first telescoping leg 202 also includes a respective lead screw assembly 600.

As noted above, each telescoping leg 202, 204, 206 includes two or more telescoping leg sections 216, 218 that enable the telescoping legs 202, 204, 206 to extend and retract to change in length 220 and raise or lower the height adjustable desk 100. The height adjustment of the height adjustable desk 100 is implemented by simultaneously changing the lengths 220 of the telescoping legs 202, 204, 206. In other words, the telescoping legs 202, 204, 206 along with the lead screw assemblies 600 implement example actuators.

The lead screw assemblies 600 each include an example threaded rod 606 (e.g., a screw rod), an example nut 608 (e.g., a threaded nut), and an example gearbox 610. Each nut 608 is coupled to a respective lower sections 218 of a respective telescoping legs 202, 204, 206 such that the threaded nut 608 remains at a stationary position. The threaded rod 606 extends through and rotatably couples to the threaded nut 608 such that a first portion of the threaded rod 606 extends into the lower section(s) 218 of the telescoping leg 202, 204, 206 and a second portion of the threaded rod 606 extends into the upper section(s) 216 of the telescoping leg(s) 202, 204, 206. The threaded rod 606 is rotationally coupled to a respective gearbox 610 at a respective second ends 212 of the telescoping leg(s) 202, 204, 206.

The lead screw assembly 600 converts rotational motion provided by the drive system 110 into linear motion that drives the first ends 208 of the telescoping legs 202, 204, 206 in an upward or downward direction while the second ends 212 of the telescoping legs 202, 204, 206 remain stationary. As the telescoping legs 202, 204, 206 raise or lower, the desktop 104 coupled to the telescoping legs 202, 204, 206 raises or lowers accordingly.

It is noted that the telescoping legs 202, 204, 206 can include other mechanical actuators capable of converting rotational motion into linear motion in additional or alternative examples. Further, the telescoping legs 202, 204, 206 can be formed in any suitable manner that enables the telescoping legs 202, 204, 206 to simultaneously change in length 220 based on work provided by the drive system 110.

Figure 7:
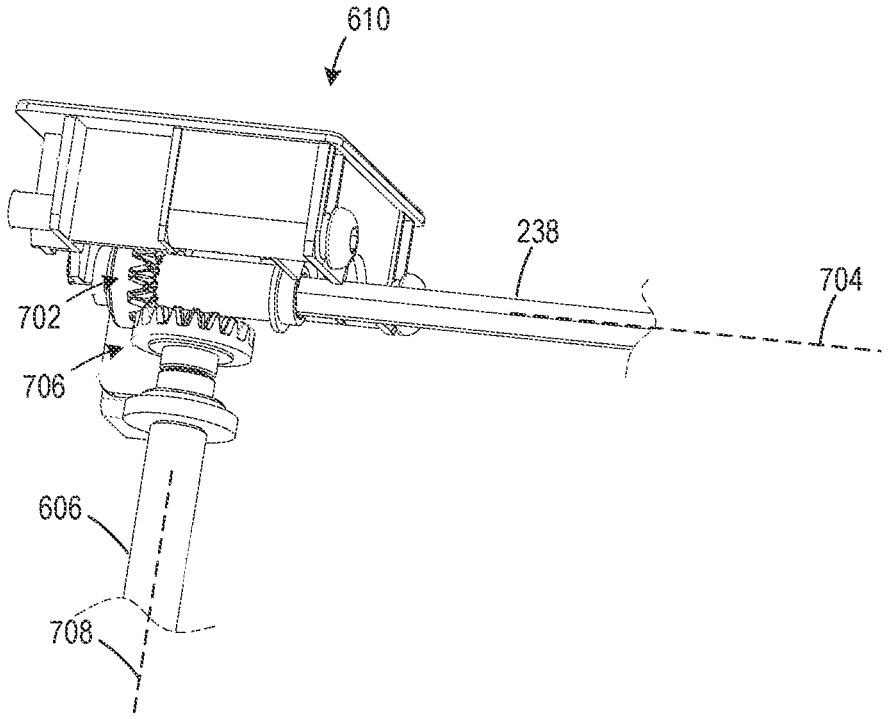
FIG. 7 is a schematic illustration of an example drive system of the height adjustable desk of FIGS. 1-6.

FIG. 7 illustrates an example gearbox 610 coupled to a threaded rod 606 and a transmission shaft 238 for changing a direction of force transmission. The gearbox 610 includes a first gear 702 positioned at a first (e.g., horizontal) axis 704 and a second gear 706 positioned at a second (e.g., vertical) axis 708. In other words, the first axis 704 is substantially perpendicular relative to the second axis 708. In this example, the first axis 704 is substantially parallel relative to the desktop 104, and the second axis 708 is substantially perpendicular relative to the desktop 104. A transmission direction is changed by meshing and connecting the first gear 702 and the second gear 706.

As used herein, the term "substantially perpendicular" encompasses the term perpendicular and more broadly encompasses a meaning whereby a first axis or component is positioned and/or oriented relative to a second axis or component at an absolute angle of no more than five degrees (5°) from absolutely perpendicular. As used herein, the term "substantially parallel" encompasses the term parallel and more broadly encompasses a meaning whereby a first axis or component is positioned and/or oriented relative to a second axis or component at an absolute angle of no more than five degrees (5°) from parallel.

As discussed above, to achieve the extension or shortening of the telescopic legs 202, 204, 206, and thus achieve the lifting/lowering effect of the desktop 104, the three telescoping legs 202, 204, 206 are used. The rotation of the threaded rod 606 is coordinated with the nut 608. Rotation of the transmission shaft 238 (e.g., caused by a motor 234, 236) causes rotation of the first gear 702. The rotation of the first gear 702 causes rotation of the second gear 706. The rotation of the second gear 706 causes rotation of the threaded rod 606. As the threaded rod 606 rotates relative to the threaded nut 604, the threaded rod 606 is caused to move relative to the second axis 708. In other words, the rotation of the threaded rod 606 relative to the threaded nut 604 causes the threaded rod 606 to raise or lower, depending on a direction of the rotation. This causes the desktop 104 to raise or lower to adjust a height of the height adjustable desk 100.

Figure 8:
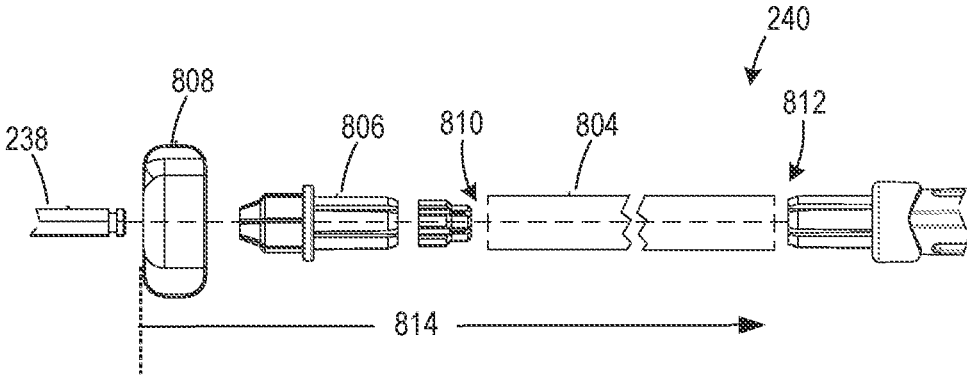
FIG. 8 is schematic illustration of an example sync rod in accordance with teachings of this disclosure.

FIG. 8 illustrates an example transmission shaft 238 coupled to an example sync rod 240 in accordance with teachings of this disclosure. As used herein, the sync rod 240 is another type of transmission shaft. That is, in some examples, the sync rod 240 implements a transmission shaft. The sync rod 240 includes an example body 804 (e.g., a tube body, etc.), an example expansion joint 806, and an example knob 808. The expansion joint 806 is located at an end 810 of the body 804, and the transmission shaft 238 enters the tube body 804 after passing through the expansion joint 806. A second end 812 of the body 804 can be coupled to the motor 234, 236 and/or another transmission shaft 238 that is coupled to the motor 234, 236.

The knob 808 is used to tighten the expansion joint 806 to change a length 814 of the sync rod 240. That is, the sync rod 240 is adjustable between a first length and a second length. In particular, by changing an amount or length of the transmission shaft 238 that is inserted into the body 804, the length 814 of the sync rod 240 can be changed, making it suitable for tables of different lengths. The transmission shaft 238 is connected to the expansion joint 806 and inserted it into the body 804. By tightening the expansion joint 806 through knob 808, the transmission shaft 238 can be fixedly coupled to the body 804 to transmit torque.

Figure 9:
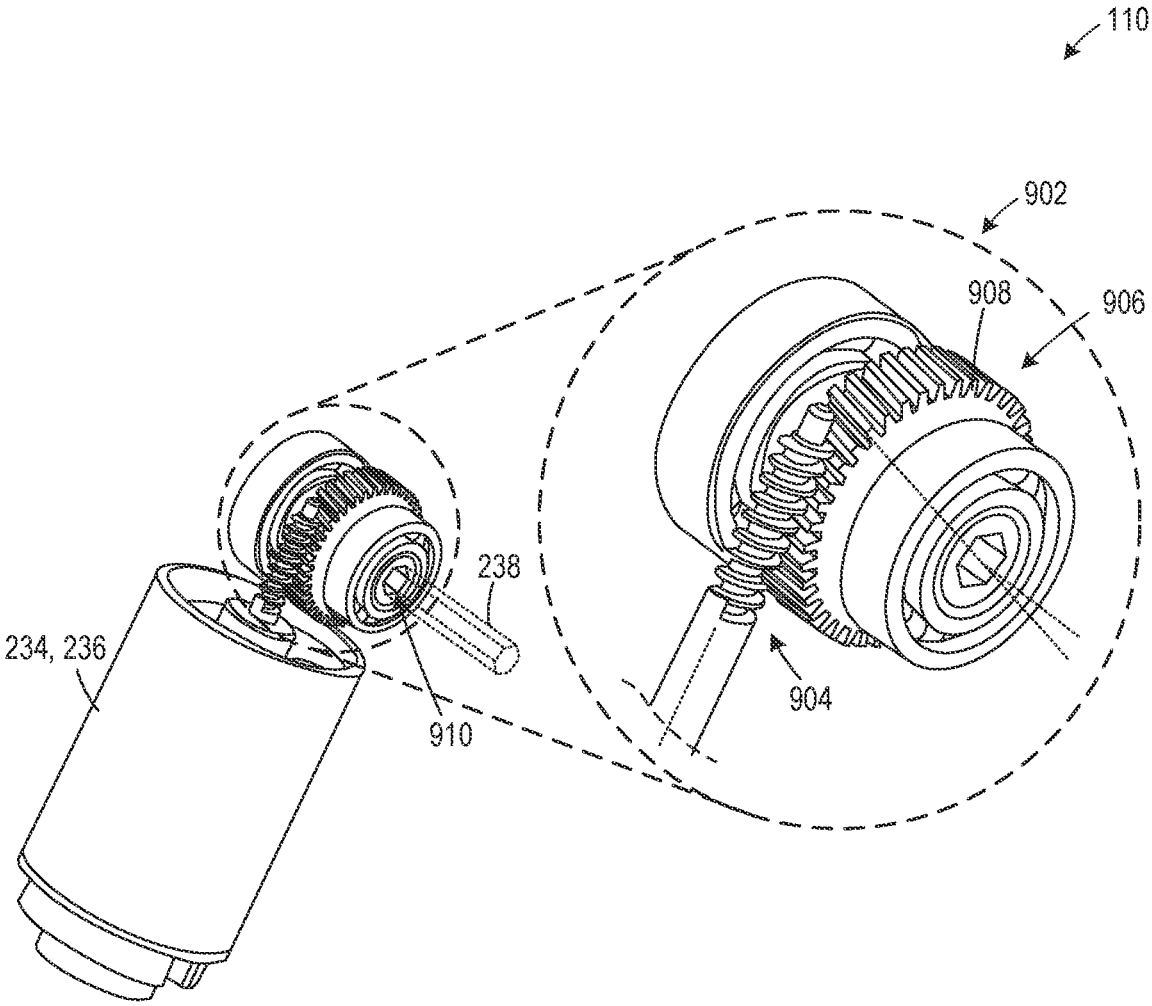
FIG. 9 is schematic illustration of an example drive system in accordance with teachings of this disclosure.

FIG. 9 illustrates another portion of the drive system 110, including an example motor 234, 236 and an example worm gear assembly 902 (e.g., worm gear, worm drive, etc.) connected to the motor 234, 236. In some examples, the motors 234, 236 are electric motors that can be controlled by electronic control equipment. For example, the electronic control equipment can include remote control and/or a control switch directly connected with wires. In examples in which the motors are controlled by electronic control equipment, the height adjust able desk 100 is an electric height adjustable desk.

In the first configuration 102 of FIGS. 1-6, two motors 234, 236 are used, one of which drives a two telescoping legs 202, 204, 206 through the sync rod 240 and a transmission shaft 238, and one of which separately drives a third telescoping leg 202, 204, 206 through another transmission shaft 238. By controlling the synchronous operation of two motors 234, 236 through electronic control equipment, the desktop 104 can be synchronously lifted and lowered. The electronic control equipment has precise control, low control difficulty, and stable lifting and lowering.

The worm gear assembly 902 is a staggered shaft gear that facilitates the transfer of motion between shafts using threads. In particular, the worm gear assembly 902 transmits motion between two shafts that are neither intersecting nor parallel. In some examples, the worm gear assembly 902 is positioned within a cover, forming a worm gearbox. In the illustrated example of FIG. 9, the cover is removed to illustrate the worm gear assembly 902. The worm gear assembly 902 includes an example worm (e.g., worm screw) 904, and an example worm wheel (e.g., worm gear) 906 meshed with the worm 904. The worm 904 is a threaded rod rotatably coupled to the motor 234, 236. The worm wheel 906 includes a plurality of teeth 908 that mesh or engage with the threads of the worm 904.

In operation, the rotation of the motor 234, 236 causes the worm 904 to rotate, and the rotation of the worm 904 drives rotation of the worm wheel 906. In other words, the drive system 110 transmits rotational motion provided by the motor(s) 234, 236 in the form of a worm wheel and a worm, which reduces the operational noise of the motor 234, 236.

The worm wheel 906 includes an example bore 910 through which the example transmission shaft 238 may extend. In operation, the worm 904 is the driving component that turns the worm wheel 906 and, resultingly, the transmission shaft 238. In some examples, the worm 904 is formed of steel, and the worm wheel 906 is formed of a high-performance composite material (e.g., to further improve the self-locking capability). For example, the worm wheel 906 may be formed of a high-toughness engineering plastic, a nylon and glass fiber composite material, etc. However, the worm 904 and/or the worm wheel 906 may be formed of another material capable of withstanding heats produced by the worm gear assembly 902 in other examples.

The drive system 110, through the rotation of the worm 904, which realizes the rotation of the worm wheel 906, drives the synchronous rising and falling of the three telescoping legs 202, 204, 206. Specifically, the drive system 110 drives the rotation of the worm 904, the rotation of which drives the rotation of the worm wheel 906. The rotation of the worm wheel 906 drives the rotation of the transmission shafts 238 and/or the sync rod 240. The rotation of the transmission shafts 238 and/or the sync rod 240 drive the gearboxes 610. The gearboxes 610 change a direction of rotation of the transmission shafts 238 to drive rotation of the threaded rods 606 with the telescoping legs 202, 204, 206. As the threaded rods 606 rotate, the threaded nuts 604 drive the threaded rods 606 in a z-direction, causing the upper sections 216 of the telescoping legs 202, 204, 206 to raise or lower (e.g., depending on the direction). Therefore, through the actions of the gearboxes 610, the transmission shafts 238, the sync rod 240 and/or the drive system 110 drives the telescoping legs 202, 204, 206 to raise or lower, causing the desktop 104 to raise or lower, respectively.

Figure 10:
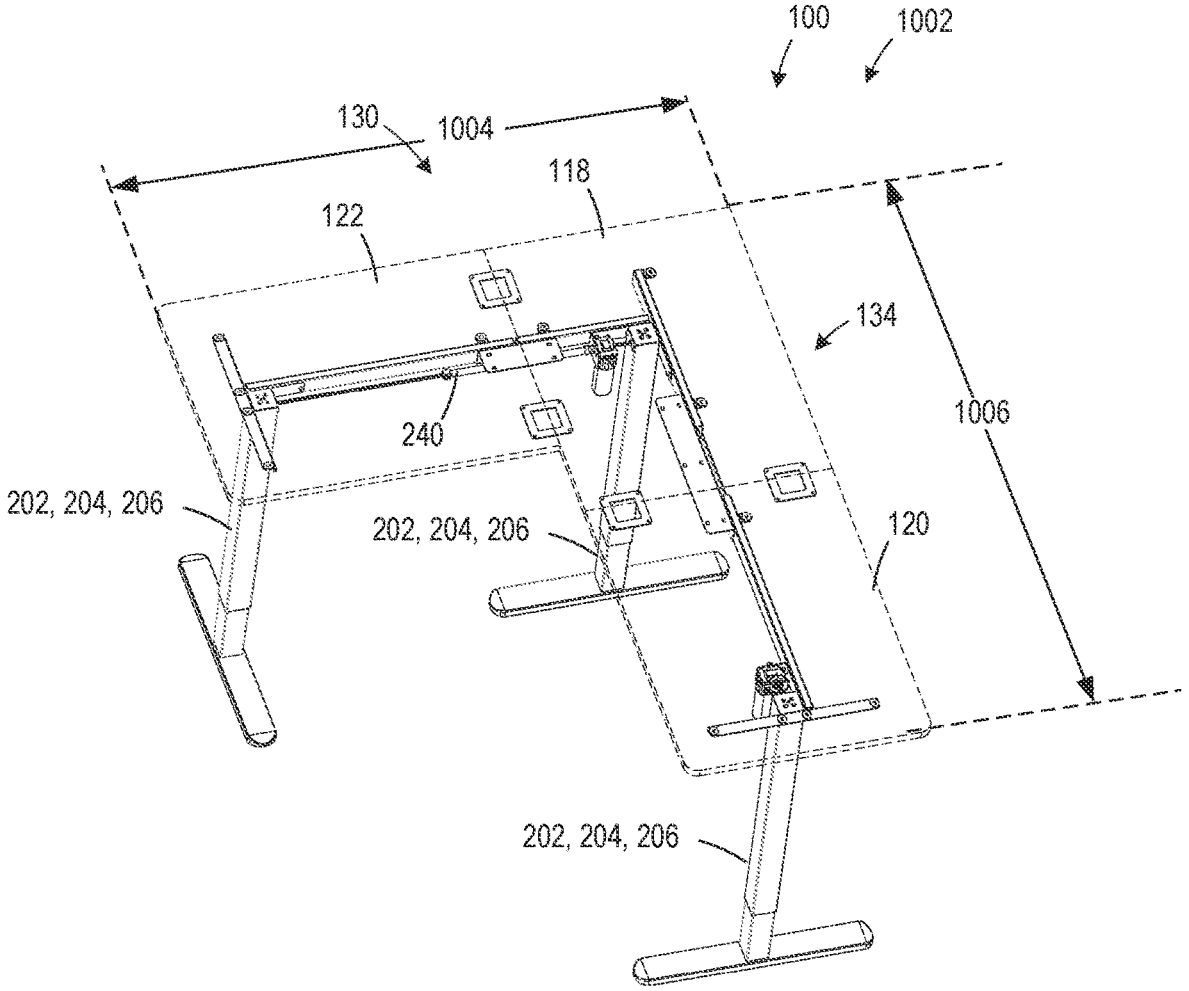
FIG. 10 illustrates an example configuration of the height adjustable desk of FIGS. 1-6 in accordance with teachings of this disclosure.

FIG. 10 illustrates an example height adjustable desk 100 in an example second configuration 1002 in accordance with teachings of this disclosure. As shown in FIG. 10, unlike the example of FIG. 1, the splicing method of the work surfaces 118, 120, 122 of FIG. 10 is different. As shown in FIG. 10, the second configuration 1002 of the height adjustable desk 100 still results in an L-shaped desk. However, in the second configuration 1002, the first side 130 of the desktop has a third length 1004, which is relatively shorter than the second side 134, which has a fourth length 1006. In particular, in the second configuration 1002, the third length 1004 of the first side 130 is smaller than the fourth length 1006 of the second side 134.

The second configuration 1002 also results in the sync rod 240 being located below the first side 130 of the L-shaped desktop 104 as opposed to the second side 134 in the first configuration 102 (FIG. 1). The sync rod 240 can be shortened in length during or before assembly of the desk 100. As illustrated in FIG. 10, each telescoping leg 202, 204, 206 is positioned below a respective work surface 118, 120, 122.

Figure 11:
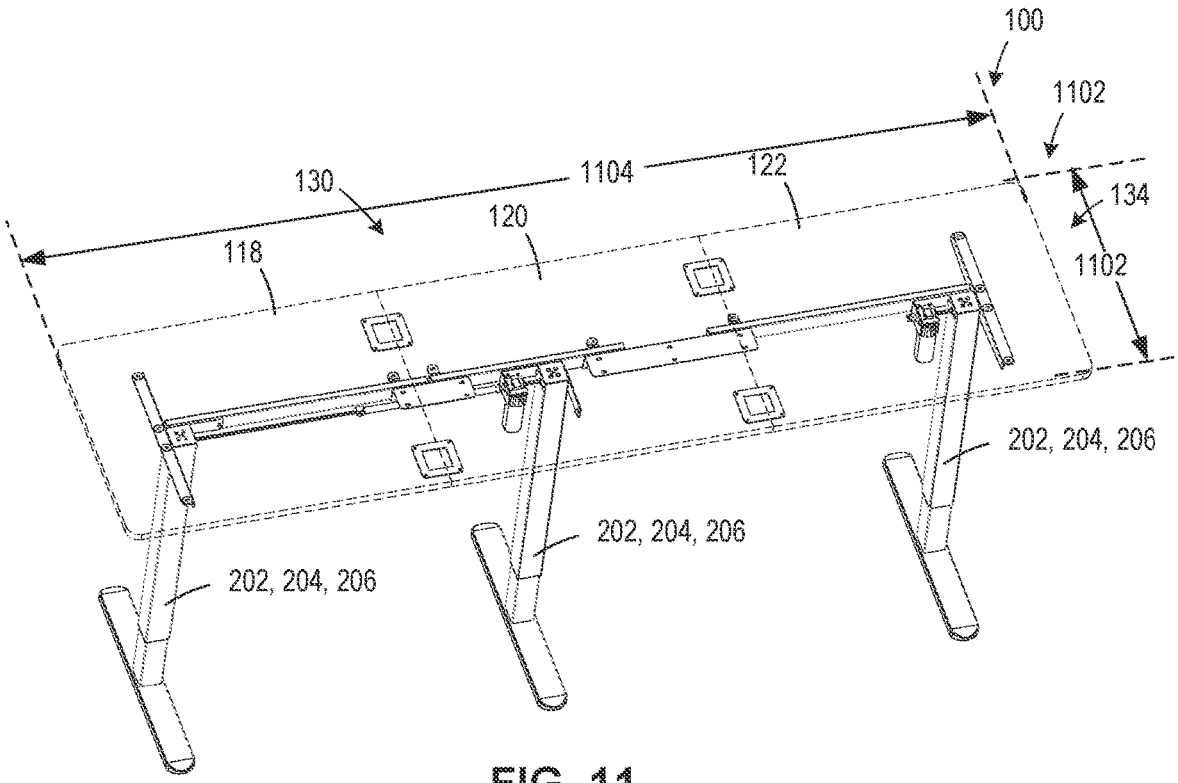
FIG. 11 illustrates another example configuration of the height adjustable desk of FIGS. 1-6 in accordance with teachings of this disclosure.

FIG. 11 illustrates an example height adjustable desk 100 in an example third configuration 1102 in accordance with teachings of this disclosure. As illustrated in FIG. 11, the three work surfaces 118, 120, 122 are spliced together to form a relatively long table. In particular, rather than being in an L-shaped configuration 102, 1002, the height adjustable desk 100 of FIG. 11 is in a straight configuration. This results in the first side 130 of the desktop 104 being longer than in the first configuration 102 and the second configuration 1002. Due to a length 1104 of the height adjustable desk 100 in the third configuration 1102, three telescoping legs 202, 204, 206 are still used. As illustrated in FIG. 11, each telescoping leg 202, 204, 206 is positioned below a respective work surface 118, 120, 122.

The second side 134 of the desktop 104 in the third configuration 1102 is shorter than the second side 134 in the first and second configurations 102, 1002. In particular, the second side 134 of the desktop 104 in the third configuration 110 has a fifth length 1106, which is shorter than the other lengths 132, 136, 1004, 1006.

Figure 12:
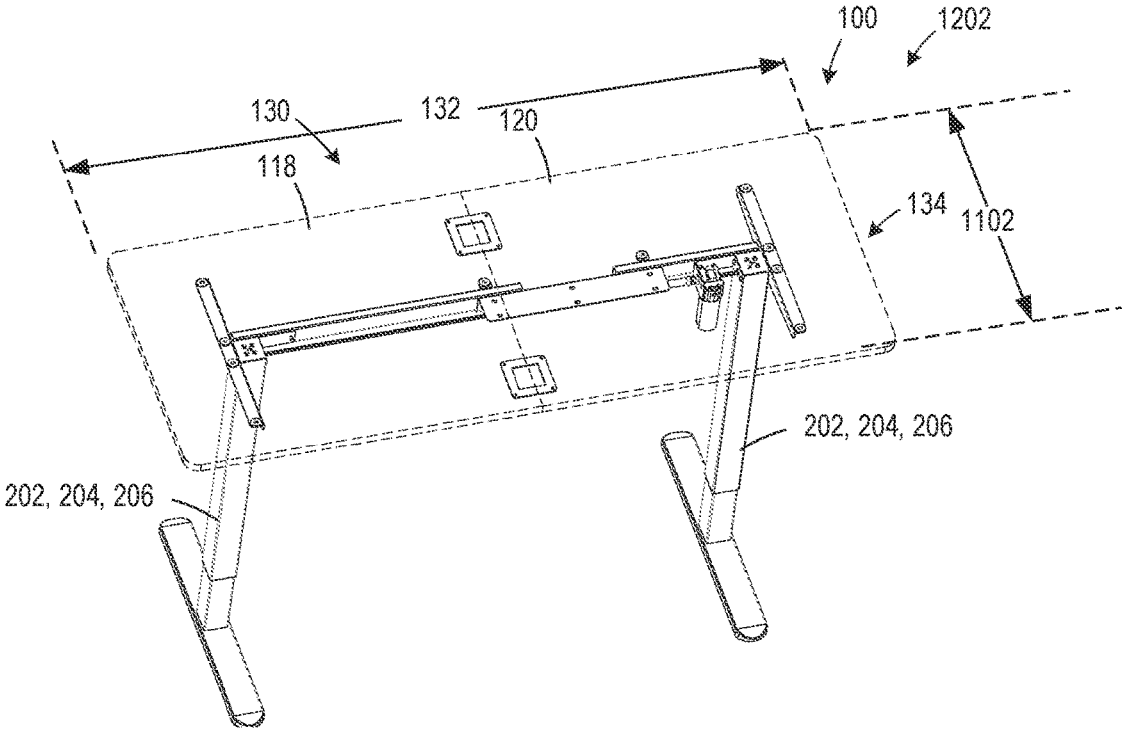
FIG. 12 illustrates yet another example configuration of the height adjustable desk of FIGS. 1-6 in accordance with teachings of this disclosure.

FIG. 12 illustrates an example height adjustable desk 100 in an example fourth configuration 1202 in accordance with teachings of this disclosure. As illustrated in FIG. 11, the two work surfaces 118, 120, 122 are spliced together to form a relatively short table. In particular, rather than being in an L-shaped configuration 102, 1002, the height adjustable desk 100 of FIG. 12 is in another straight configuration. However, because only two work surfaces 118, 120, 122 are used, the first side 130 of the desktop 104 is shorter than in the third configuration 1102. In some examples, the first side 130 of the desktop 104 in the fourth configuration 1202 is substantially similar to the first side 130 of the desktop 104 in the first configuration 102 or the second configuration 1002.

Due to a length 1104 of the height adjustable desk 100 in the third configuration 1102, three telescoping legs 202, 204, 206 are still used. As illustrated in FIG. 11, each telescoping leg 202, 204, 206 is positioned below a respective work surface 118, 120, 122. As illustrated in FIG. 12, two work surfaces 118, 120, 122 are used to form the desktop 104 of the height adjustable desk 100. In this example, there are even number of telescoping legs 202, 204, 206, which are driven by one motor 234, 236.

From the foregoing, it will be appreciated that example systems, apparatus, articles of manufacture, and methods have been disclosed that facilitate production of a reconfigurable, height adjustable desk. In particular, examples disclosed herein enable manufacture of a height adjustable desk that can readily be constructed into a plurality of different configurations using one or more of a set of materials. Further, example disclosed herein enable the synchronous height adjustment of two or more telescoping legs. Moreover, examples disclosed herein utilize a worm gear assembly and/or a silent motor to reduce an amount of noise emitted during height adjustment of an example height adjustable desk disclosed herein.

Example height adjustable desks are disclosed herein. Further examples and combinations thereof include the following:

Example 1 includes a height adjustable desk comprising telescoping legs, each telescoping leg including an upper section, a lower section, and an actuator, each telescoping leg having a first end and a second end, a drive system having a motor and a worm gear assembly having a worm and a worm wheel, gearboxes, each gearbox coupled to a respective telescoping leg, transmission shafts connected to the drive system and to the gearboxes wherein the drive system is configured to drive the transmission shafts to drive the telescoping legs together to raise and lower, and a desktop having work surfaces including a first work surface, a second work surface, and a third work surface, the first ends of the telescoping legs to interface with and support the desktop, wherein the desktop is formed by coupling two or more of the work surfaces.

Example 2 includes the height adjustable desk of example 1, wherein one or more of the telescoping legs includes a support base.

Example 3 includes the height adjustable desk of example 1, wherein each respective telescoping leg is positioned relative to a respective desktop section.

Example 4 includes the height adjustable desk of example 1, further including connection frame coupled between adjacent ones of the telescoping legs, the connection frame including frame rods and a frame rod connector coupling the frame rods.

Example 5 includes the height adjustable desk of example 4, wherein the connection frame is a first connection frame and the frame rod connector is a first frame rod connector, the desk further including a second connection frame, the second connection frame including a second frame rod connector, wherein the second frame rod connector is longer relative to the first frame rod connector.

Example 6 includes the height adjustable desk of example 4, wherein the frame rod connector includes a groove, the frame rods to slide relative to the groove.

Example 7 includes the height adjustable desk of example 4, wherein the frame rod connector is coupled to a first surface of the desktop.

Example 8 includes the height adjustable desk of example 1, wherein each telescoping leg includes a screw assembly coupled within the respective telescoping leg.

Example 9 includes the height adjustable desk of example 1, wherein each telescoping leg includes a gearbox coupled thereto.

Example 10 includes the height adjustable desk of example 1, wherein the worm of the drive system is coupled between the motor and the worm wheel.

Example 11 includes the height adjustable desk of example 1, wherein the worm includes a threaded portion, and the worm gear includes teeth that engage with the threaded portion of the worm.

Example 12 includes the height adjustable desk of example 1, wherein the actuators of the telescoping legs include lead screw assemblies.

Example 13 includes a height adjustable table comprising telescoping legs structured to support a desktop, each telescoping leg including an actuator, each telescoping leg having a first end and a second end, a drive system having a motor, a worm, and a worm wheel, gearboxes, each gearbox coupled to a respective ones of the telescoping legs, transmission shafts connected to the drive system and to the gearboxes, the transmission shafts including a sync rod adjustable between a first length and a second length, wherein the drive system is configured to drive the transmission shafts to drive the telescoping legs together to rise and fall; and a desktop having work surfaces including a first work surface, a second work surface, and a third work surface, first ends of the telescoping legs to interface with the desktop.

Example 14 includes the height adjustable table of example 13, wherein the desktop includes a first side and a second side.

Example 15 includes the height adjustable table of example 14, wherein the desktop is configurable in a first configuration, the first configuration being a first L-shaped configuration, wherein the first side is longer than the second side in the first L-shaped configuration.

Example 16 includes the height adjustable table of example 15, wherein the desktop is configurable in a second configuration, the first configuration being a second L-shaped configuration, wherein the first side is shorter than the second side in the second L-shaped configuration.

Example 17 includes the height adjustable table of example 14, wherein the desktop is configurable in a third configuration, the third configuration being a first straight configuration, wherein the first side is longer than the second side in the third configuration.

Example 18 includes the height adjustable table of example 17, wherein the desktop in the third configuration includes the first work surface, the second work surface, and the third work surface.

Example 19 includes the height adjustable table of example 17, wherein the desktop is configurable in a fourth configuration, the fourth configuration being a second straight configuration, wherein the first side of the desktop in the second straight configuration is shorter than the first side of the desktop in the first straight configuration, and wherein the desktop includes two desktop sections in the fourth configuration.

Example 20 includes the height adjustable table of example 13, further including connection frame coupled between adjacent ones of the telescoping legs, the connection frame including frame rods and a frame rod connector coupling the frame rods.

It is noted that this patent claims priority from Chinese Patent Application Number 202210970179.8, which was filed on Oct. 11, 2023, and is hereby incorporated by reference in its entirety.

The following claims are hereby incorporated into this Detailed Description by this reference. Although certain example systems, apparatus, articles of manufacture, and methods have been disclosed herein, the scope of coverage of this patent is not limited thereto. On the contrary, this patent covers all systems, apparatus, articles of manufacture, and methods fairly falling within the scope of the claims of this patent.

What is claimed is:

1. A height adjustable desk comprising:

telescoping legs, each telescoping leg including an upper section, a lower section, and an actuator, each telescoping leg having a first end and a second end;

a drive system having a motor and a worm gear assembly having a worm and a worm wheel;

gearboxes, each gearbox coupled to a respective telescoping leg;

transmission shafts connected to the drive system and to the gearboxes, wherein the drive system is configured to drive the transmission shafts to drive the telescoping legs together to raise and lower; and a desktop having work surfaces including a first work surface, a second work surface, and a third work surface, the first ends of the telescoping legs to interface with and support the desktop, wherein the desktop is formed by coupling two or more of the work surfaces, the two or more of the work surfaces movable between a first configuration and a second configuration, wherein, in the first configuration, a first of the two or more work surfaces extends perpendicular to a second of the two or more work surfaces to form an L-shaped desktop and wherein, in the second configuration, the first of the two or more work surfaces extends along a line with the second of the two or more work surfaces to form a straight desktop, the desktop re-configurable in the first configuration and the second configuration for use.

2. The height adjustable desk of claim 1, wherein one or more of the telescoping legs includes a support base.

3. The height adjustable desk of claim 1, wherein each respective telescoping leg is positioned relative to a respective desktop section.

4. The height adjustable desk of claim 1, further including connection frame coupled between adjacent ones of the telescoping legs, the connection frame including frame rods and a frame rod connector coupling the frame rods.

5. The height adjustable desk of claim 4, wherein the connection frame is a first connection frame and the frame rod connector is a first frame rod connector, the desk further including a second connection frame, the second connection frame including a second frame rod connector, wherein the second frame rod connector is longer relative to the first frame rod connector.

6. The height adjustable desk of claim 4, wherein the frame rod connector includes a groove, the frame rods to slide relative to the groove.

7. The height adjustable desk of claim 4, wherein the frame rod connector is coupled to a first surface of the desktop.

8. The height adjustable desk of claim 1, wherein each telescoping leg includes a screw assembly coupled within the respective telescoping leg.

9. The height adjustable desk of claim 1, wherein each telescoping leg includes a gearbox coupled thereto.

10. The height adjustable desk of claim 1, wherein the worm of the drive system is coupled between the motor and the worm wheel.

11. The height adjustable desk of claim 1, wherein the worm includes a threaded portion, and the worm gear includes teeth that engage with the threaded portion of the worm.

12. The height adjustable desk of claim 1, wherein the actuators of the telescoping legs include lead screw assemblies.

13. A height adjustable table comprising:

telescoping legs structured to support a desktop, each telescoping leg including an actuator, each telescoping leg having a first end and a second end;

a drive system having a motor, a worm, and a worm wheel;

gearboxes, each gearbox coupled to a respective ones of the telescoping legs;

transmission shafts connected to the drive system and to the gearboxes, the transmission shafts including a sync rod adjustable between a first length and a second length, wherein the drive system is configured to drive the transmission shafts to drive the telescoping legs together to raise and lower; and a desktop having work surfaces including a first work surface, a second work surface, and a third work surface, first ends of the telescoping legs to interface with the desktop, the first, second, and third work surfaces movable between an L-shaped configuration and a straight configuration, the desktop re-configurable in the L-shaped configuration and the straight configuration for use.

14. The height adjustable table of claim 13, wherein the desktop includes a first side and a second side.

15. The height adjustable table of claim 14, wherein the L-shaped configuration is a first L-shaped configuration, wherein the first side is longer than the second side in the first L-shaped configuration.

16. The height adjustable table of claim 15, wherein the desktop is configurable in a second L-shaped configuration, wherein the first side is shorter than the second side in the second L-shaped configuration.

17. The height adjustable table of claim 14, wherein the straight configuration is a first straight configuration, wherein the first side is longer than the second side in the first straight configuration.

18. The height adjustable table of claim 17, wherein the desktop in the first straight configuration includes the first work surface, the second work surface, and the third work surface.

19. The height adjustable table of claim 17, wherein the desktop is configurable in a second straight configuration, wherein the first side of the desktop in the second straight configuration is shorter than the first side of the desktop in the first straight configuration, and wherein the desktop includes two desktop sections in the second straight configuration.

20. The height adjustable table of claim 13, further including connection frame coupled between adjacent ones of the telescoping legs, the connection frame including frame rods and a frame rod connector coupling the frame rods.

* * * * *